US009364375B2

(12) United States Patent
Youngmann et al.

(10) Patent No.: US 9,364,375 B2
(45) Date of Patent: Jun. 14, 2016

(54) PATIENT TRANSPORT PLATFORM

(71) Applicant: TransMotion Medical, Inc., Sharon Center, OH (US)

(72) Inventors: Trevor Youngmann, Middleburg Heights, OH (US); Brian Huml, Medina, OH (US); David Heidenreich, Akron, OH (US); Nathan Yensho, Norton, OH (US); Michael Maske, Scottsdale, AZ (US)

(73) Assignee: WINCO MFG., LLC, Ocala, FL (US)

( * ) Notice: Subject to any disclaimer, the term of this patent is extended or adjusted under 35 U.S.C. 154(b) by 0 days.

(21) Appl. No.: 14/375,883

(22) PCT Filed: Jan. 30, 2013

(86) PCT No.: PCT/US2013/023844

§ 371 (c)(1),
(2) Date: Jul. 31, 2014

(87) PCT Pub. No.: WO2013/116336

PCT Pub. Date: Aug. 8, 2013

(65) Prior Publication Data

US 2015/0014959 A1 Jan. 15, 2015

Related U.S. Application Data

(60) Provisional application No. 61/632,775, filed on Jan. 31, 2012.

(51) Int. Cl.

| | |
|---|---|
| ***A61G 1/017*** | (2006.01) |
| ***A61G 5/00*** | (2006.01) |
| ***A61G 5/10*** | (2006.01) |

(Continued)

(52) U.S. Cl.

CPC ..... *A61G 1/017* (2013.01); *A61G 1/0237* (2013.01); *A61G 1/0275* (2013.01); *A61G 5/00* (2013.01); *A61G 5/006* (2013.01); *A61G 5/04* (2013.01); *A61G 5/1059* (2013.01); *A61G 5/043* (2013.01); *A61G 7/005* (2013.01);

(Continued)

(58) Field of Classification Search

CPC ... A61G 1/017; A61G 1/0237; A61G 1/0275; A61G 5/00; A61G 5/04; A61G 5/006; A61G 5/1059; A61G 5/043; A61G 2200/32; A61G 2200/34; A61G 2005/1089; A61G 2005/005; A61G 2005/1078

USPC ..... 280/250.1

See application file for complete search history.

(56) References Cited

U.S. PATENT DOCUMENTS

2001/0011613 A1* 8/2001 Schaffner et al. ..... 180/65.1
2005/0138731 A1 6/2005 Failor et al.

(Continued)

*Primary Examiner* — Joseph Rocca
*Assistant Examiner* — Felicia L Brittman
(74) *Attorney, Agent, or Firm* — Renner, Kenner, Greive, Bobak, Taylor & Weber Co., LPA

(57) ABSTRACT

Embodiments of a patient transport platform employing one or more adjustable columns interposed between a base having caster wheels with one or more intermediate large wheels, the adjustable columns accommodating deployment and retraction of the large wheels and elevation and positioning of an articulating patient stretcher chair. In various embodiments, the adjustable columns are in parallel or series connection, or combinations thereof. An articulating base frame assembly with a dampened interconnection between fore and aft sections, having three pairs of wheels for selective implementation in use is also presented.

15 Claims, 13 Drawing Sheets

(51) Int. Cl.

| | |
|---|---|
| ***A61G 1/02*** | (2006.01) |
| *A61G 5/04* | (2013.01) |
| *A61G 7/005* | (2006.01) |

(52) U.S. Cl.

CPC ..... *A61G 2005/1078* (2013.01); *A61G 2005/1089* (2013.01); *A61G 2200/32* (2013.01); *A61G 2200/34* (2013.01)

(56) References Cited

U.S. PATENT DOCUMENTS

| | | | | |
|---|---|---|---|---|
| 2005/0206149 | A1* | 9/2005 | Mulhern et al. | 280/755 |
| 2008/0087481 | A1 | 4/2008 | Grymko et al. | |
| 2011/0272200 | A1* | 11/2011 | Clapp et al. | 180/54.1 |

* cited by examiner

PATIENT TRANSPORT PLATFORM

CROSS REFERENCE TO RELATED APPLICATION

This application hereby claims the benefit of and priority to U.S. Provisional Patent Application 61/632,775, filed Jan. 31, 2012, titled "Patient Transport Platform," which is hereby incorporated by reference in its entirety.

TECHNICAL FIELD

The invention herein resides in the art of patient transport and procedure devices. More particularly, the invention relates to such devices that provide for ease of maneuverability and access by the patient, while providing a broad range of procedural utility. Specifically, the invention relates to a patient transport platform that allows for improved mobility by incorporating a set of castered wheels with an interposed pair of deployable large diameter wheels, in conjunction with a seat having a range of adjustable heights and orientations so as to accommodate ease of patient accessibility and care giver utility. Also presented is an articulated base frame assembly with a dampened interconnection between fore and aft sections, having pairs of wheels selectively adapted for implementation in use.

BACKGROUND ART

There are numerous and various patient transport devices presently known. Most of them employ a platform with a castered wheel at each of four corners thereof, the castered wheels being of small diameter and not given to ease of mobility on anything but the smoothest and flattest of hard surfaces. Typically, patient transport stretcher chairs have also had a lowest seat height in the range of 24 inches, making the same difficult to access by the patient. Moreover, presently existent transport chairs that are adapted for use as treatment or medical procedure stretchers or platforms have been of a complex structure with attendant high costs.

SUMMARY OF THE INVENTION

In light of the foregoing, it is a first aspect of embodiments of the invention to provide a patient transport platform that is easy to move and steer over a wide range of floor surfaces.

Another aspect of the invention is the provision of a patient transport platform in which the seat height may be significantly lowered over presently existing units, providing for ease of entrance and exit by patients.

Yet a further aspect of the invention is the provision of a patient transport platform that provides a wide range of positions and orientations to accommodate not only the transport of a patient, but the undertaking of medical procedures, examinations and the like, while still providing for patient comfort.

Still a further aspect of the invention is the provision of a patient transport platform having an articulating base for ease of use with a stretcher chair.

An additional aspect of the invention is the provision of a patient transport platform having an articulating base of sections interconnected to accommodate free floating and dampened actions therebetween.

Another aspect of the invention is the provision of a patient transport platform wherein mobility is achieved by positioning an intermediate pair of large wheels between fore and aft pairs of wheels, either centrally therebetween or toward the aft pair of wheels.

The foregoing and other aspects of embodiments of the invention that will become apparent as the detailed description proceeds are achieved by a patient transport device, comprising: a base; castered wheels attached to said base; a support structure mounted to said base for receiving and maintaining a patient; at least two height adjusting mechanisms mounted in series between said base and said support structure; an axle with at least one large wheel supported by springs from the base; a first of the two adjusting mechanisms having an ability to engage the axle of the large wheel for a short distance at the lower end of its stroke; and where said first adjusting mechanism has the ability to vertically float toward the bottom of the stroke when the large diameter wheel is in contact with the floor surface, supporting most of the patient and patient support device weight.

Certain other aspects of embodiments of the invention are achieved by a patient transport device, comprising: a bifurcated articulating base having fore and aft portions; a pair of fore caster wheels connected to said fore portion and a pair of aft caster wheels connected to said aft portion; at least one large wheel, larger in diameter than said fore and aft caster wheels, interposed between said pairs of fore and aft caster wheels; and an actuator interposed between said fore and aft portions and effecting articulation therebetween and thereby altering vertical positional relationships among said large wheel and said pairs of fore and aft caster wheels.

DESCRIPTION OF DRAWINGS

For a complete understanding of the various aspects, structures and techniques of the embodiments of the invention, reference should be made to the following detailed description and accompanying drawings wherein.

DETAILED DESCRIPTION OF PREFERRED EMBODIMENTS

Figure 1A:
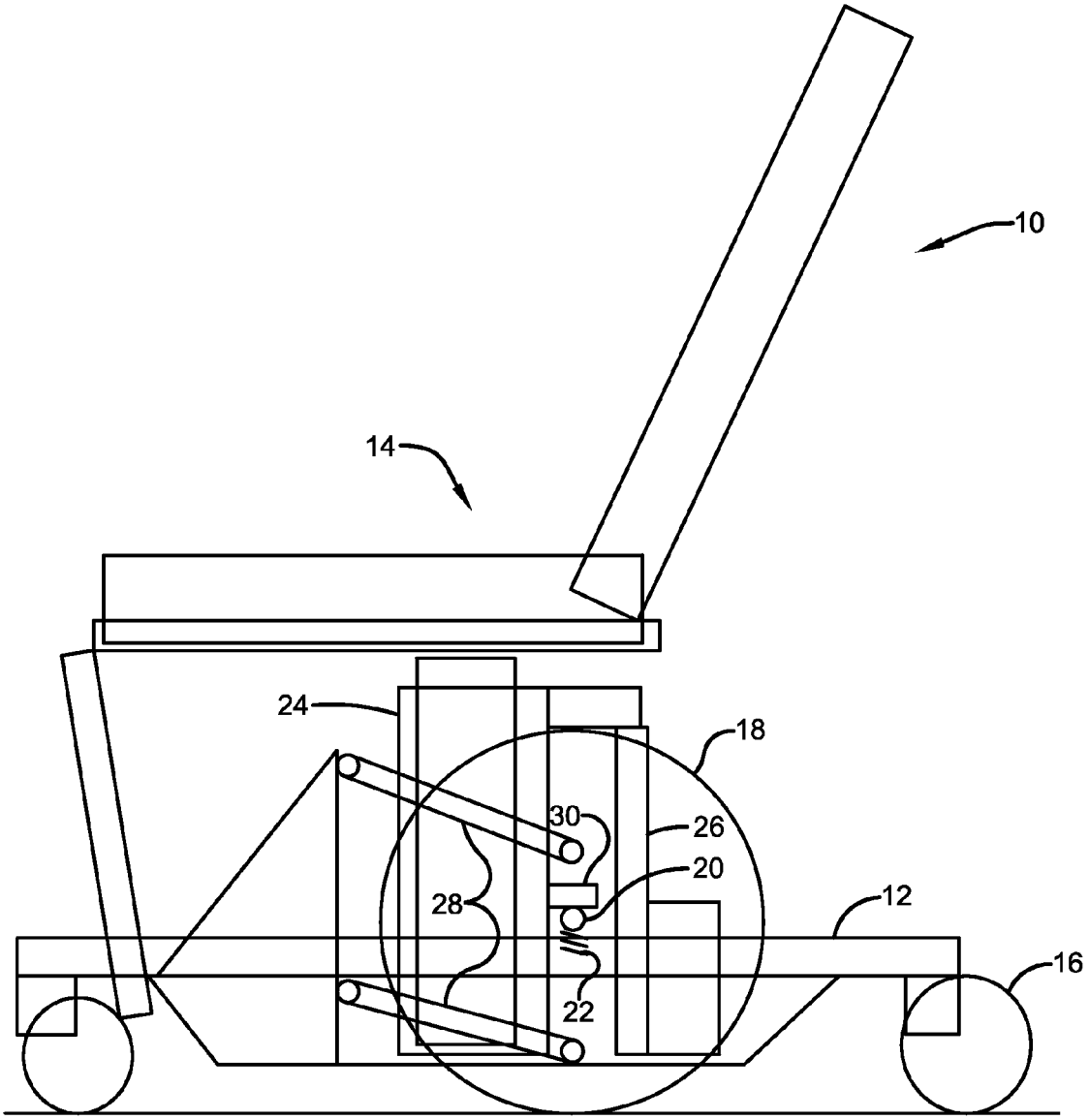
FIGS. 1A and 1B are illustrative drawings of a first embodiment of the invention employing series-connected actuators with a double wishbone suspension or four bar parallel linkage for effecting movement of an associated chair and deployment and retraction of a pair of large central wheels.
Figure 1B:
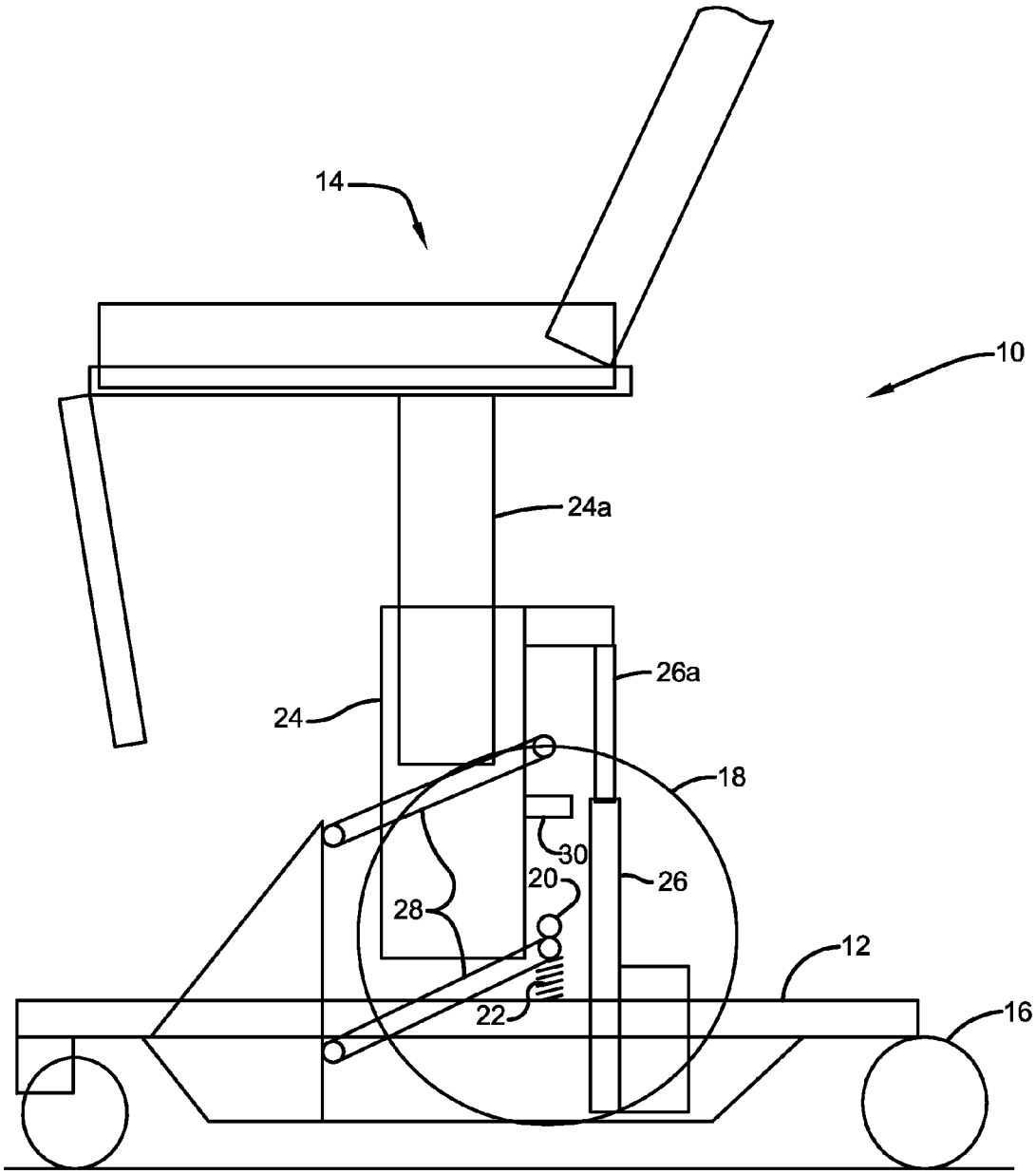

Referring now to the drawings and more particularly FIGS. 1A and 1B, an appreciation can be obtained of the structure and operation of a first embodiment of the invention. This embodiment shows a patient transport platform wherein the height adjustment mechanism is divided into two independently controlled mechanisms operating in series. They include a typical adjustable column actuator plus a modified double wishbone suspension of the column such that it is adjusted by a separate actuator. A protrusion on the outer part of the column can rest on the axle of the large wheel in the lowered position. The double wishbone actuator has a free floating ability at the bottom of its stroke. When this actuator is raised, springs lift the wheel axle above the floor to allow movement and positioning of the patient transport device on its castors.

With specific attention to FIGS. 1A and 1B, it will be appreciated that a patient transport platform according to a first embodiment of the invention is designated generally by the numeral 10. The device 10 includes a base 12 supporting a stretcher chair 14. In standard fashion, the stretcher chair 14 includes seat, back and leg rest portions, capable of articulating with respect to each other between a chair orientation and a stretcher orientation. At each of the four corners of the base 12 are caster wheels 16, typically being of rather small diameter, on the order of 3-5 inches. A pair of large diameter wheels 18 (only one shown in the drawings) is interposed between the pairs of fore and aft caster wheels 16. The large diameter wheels 18 can have a diameter on the order of 12-20 inches. The large wheels 18 are maintained upon an axle 20, the axle 20 being biased from the frame by means of a pair of springs 22 interposed between the base 12 and the axle 20. The springs 22 may be of any suitable type, but are preferably compression springs, urging the wheel 18 away from the floor or support surface. The springs 18 are counteracted by the combined weight of the chair 14 and patient, the added weight of the patient being sufficient to bring the wheels 18 into contact with the floor or supporting surface, against the urging of the springs 22.

A column actuator 24 and suspension actuator 26 are connected in series and interposed between the stretcher chair 14 and base 12. The actuators 24, 26 may be of any suitable type, including hydraulic, pneumatic, electrical or mechanical. Each has an associated piston or column 24*a* and 26*a*, as shown in FIG. 1B. The suspension actuator 26 is interconnected with a double wishbone suspension 28 of the column actuator 24. A stop 30 is provided on the column actuator 24 and is positioned and adapted for engagement with the axle 20 of the large wheels 18.

In use, the actuator 24 may be used to raise or lower the stretcher chair 14 by means of the associated piston 24*a*. The suspension actuator 26 and associated piston 26*a* serve to raise the column actuator 24 and associated double wishbone suspension 28, as best shown in FIG. 1B.

As presented above, the suspension actuator 26 is preferably characterized by a dead band or free floating range at the bottom of its stroke, accommodating compression of the spring 22 and urging of the wheel 18 into contact with a floor surface by the combined weight of the patient and the stretcher chair 14.

Figure 2A:
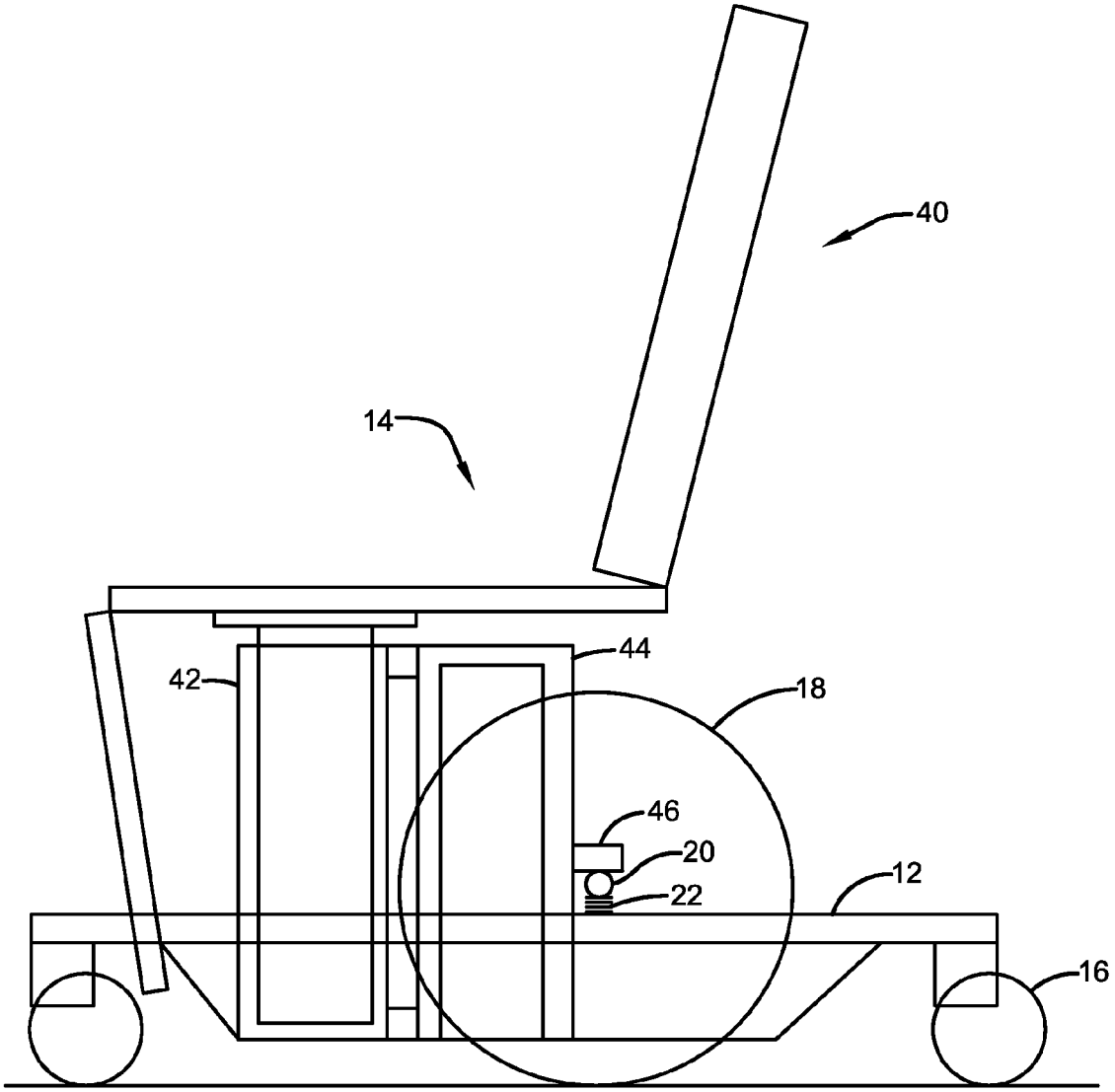
FIGS. 2A and 2B are illustrative drawings of a second embodiment of the invention employing a pair of series-connected column actuators, but without the double wishbone suspension.
Figure 2B:
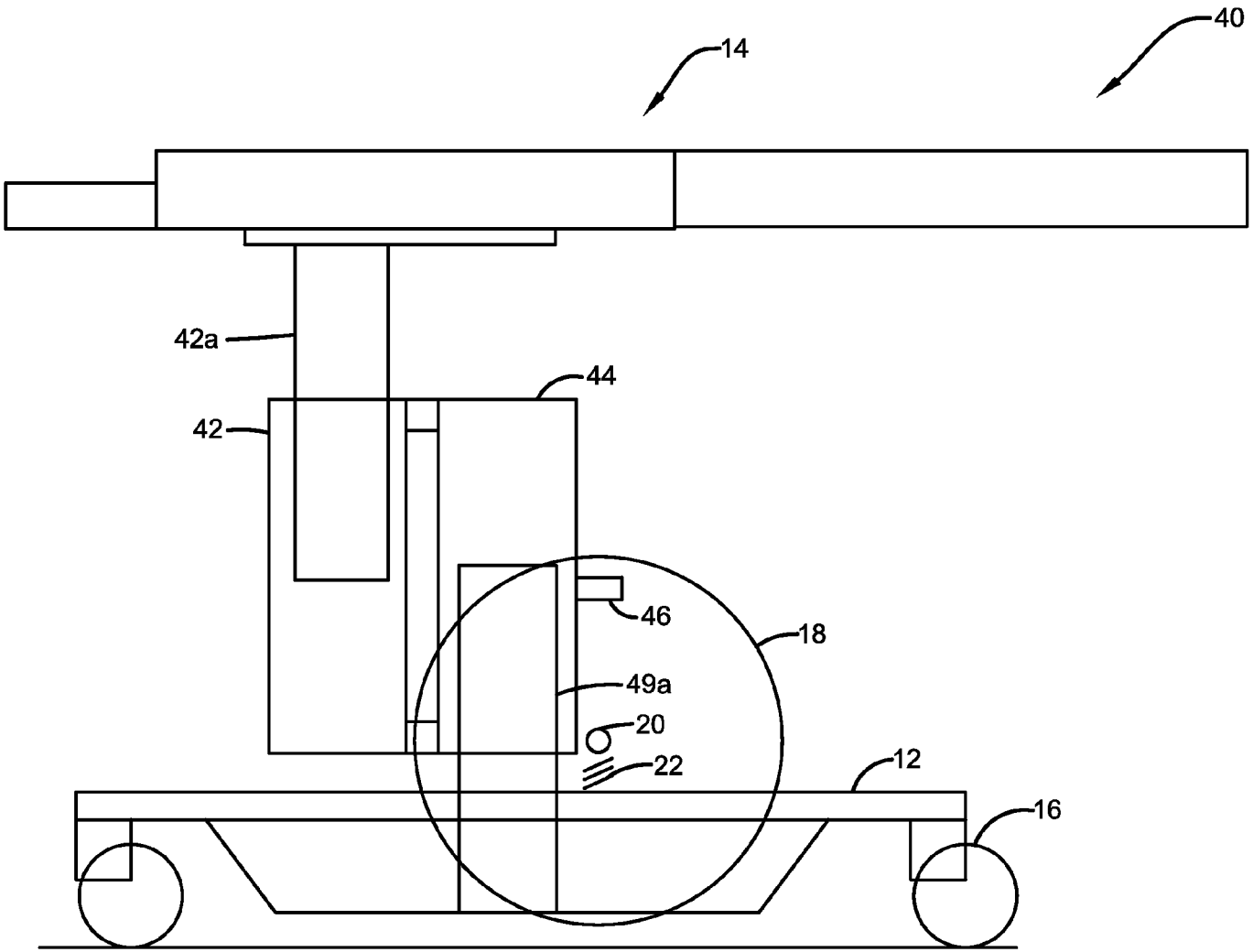

With reference now to FIGS. 2A and 2B, a second embodiment of a patient transport platform made in accordance with the invention can be seen as designated generally by the numeral 40. The unit 40 is similar to the unit 10 and, to the degree of such similarity, the same numerals are used to designate similar elements. Again, a base 12 receives a stretcher chair 14 and has at the four corners thereof caster wheels 16 with a pair of larger wheels 18 positioned therebetween. The wheels 18 are rotatable about an axle 20, which is again biased by a compression spring 22, or the like. Here, however, there is no wishbone suspension, but rather a pair of adjustable columns 42, 44 in series connection. The adjustable column 42 has an associated piston 42*a* that extends therefrom and is operatively connected to the stretcher chair 14. In like manner, the adjustable column 44 has a piston 44*a* that is affixed to the base 12. A stop 46 is attached to the adjustable collum 44 and is adapted to rest upon the axle 20, for operation in a fashion substantially similar to that of the embodiment 10, but for the replacement of the double wishbone suspension.

Figure 3A:
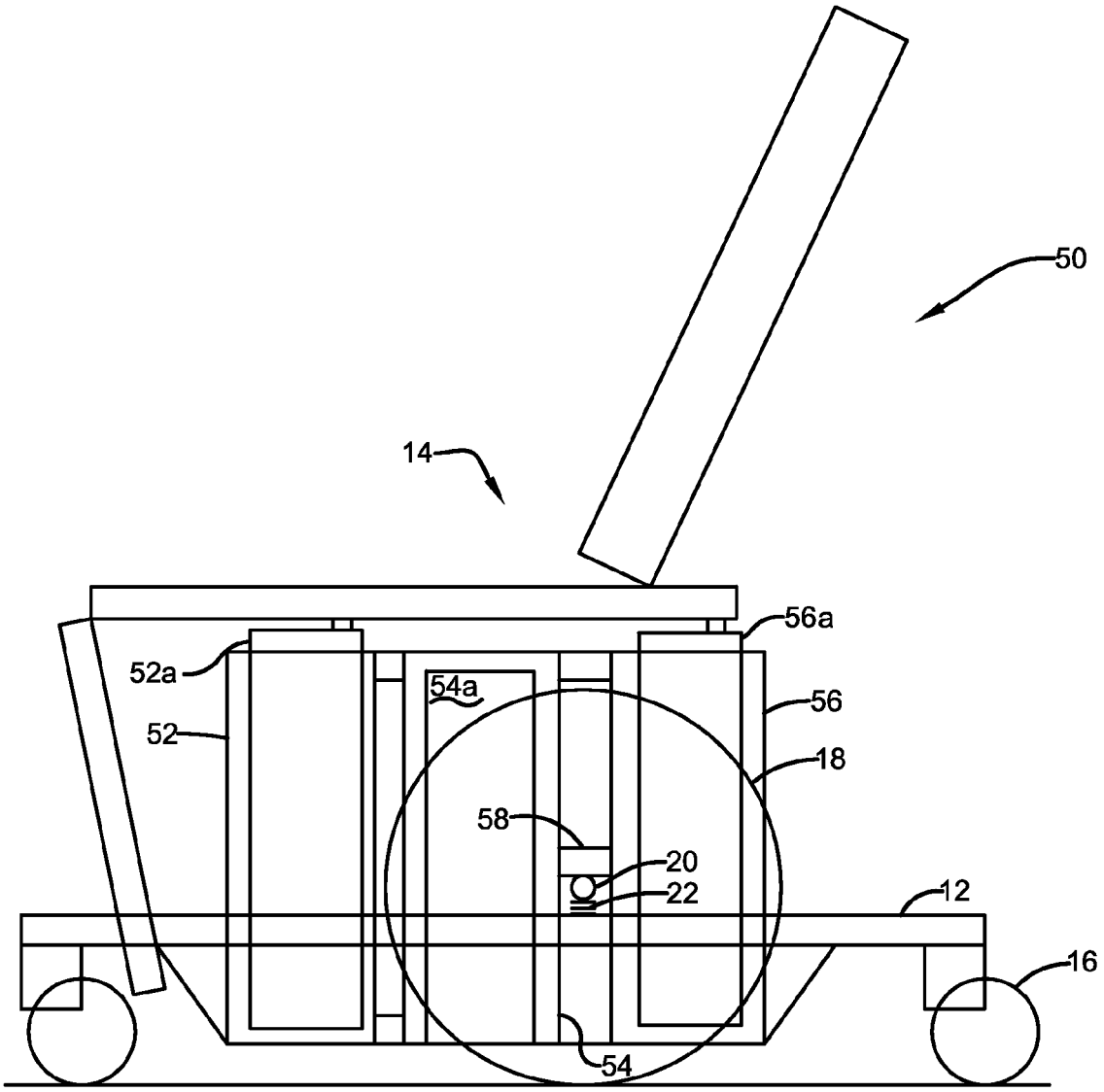
FIGS. 3A-3D are illustrative drawings of a third embodiment of the invention employing a pair of fore and aft column actuators in parallel connection with each other and in series connection with an interposed column actuator, showing various states of actuation thereof.
Figure 3B:
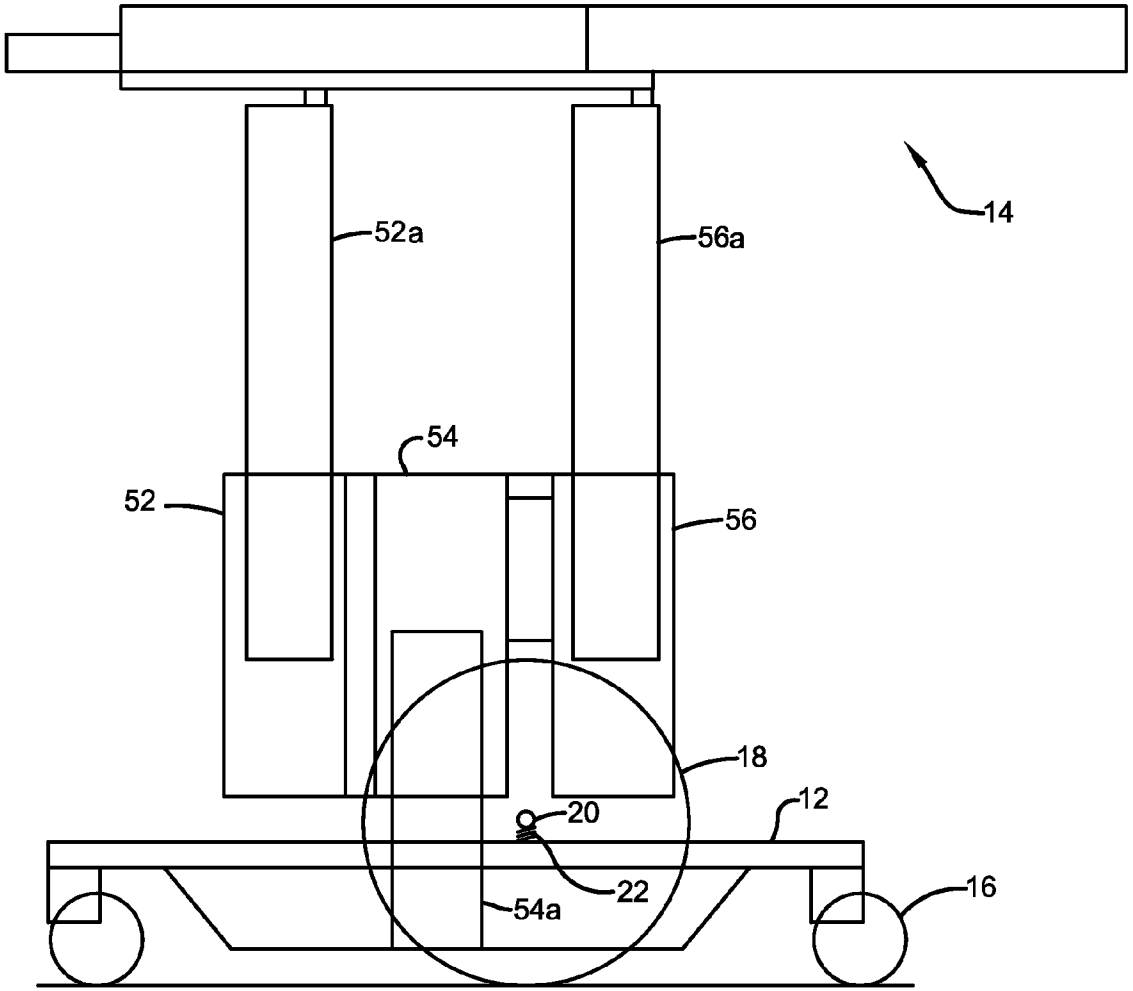

With reference now to FIGS. 3A-3B, an appreciation can be attained with regard to a third embodiment of a patient transport platform made in accordance with the invention and designated generally by the numeral 50. Here, adjustable columns 52, 54, 56 are operatively interconnected, having respective pistons 52*a*, 54*a*, and 56*a*. Pistons 52*a* and 56*a* are operatively connected to the stretcher chair 14, such as the seat portion, while the piston 54*a* is connected to the base 12. The adjustable columns and associated pistons 52, 56 are interconnected in parallel, with that combination being in series interconnection with the adjustable column 54. The adjustable column 54 has an associated stop 58, adapted for engagement with the axle 20 of the large wheels 18, as discussed above. For that purpose, the piston 54*a* of the adjustable column 54 is free floating at the bottom of its stroke, to accommodate movement as against the spring 22 when a patient is received within the chair.

FIG. 3A shows the patient transport platform with the stretcher chair 14 at its maximum height, with the pistons 52*a*, 56*a* at maximum extension from the adjustable column actuators 52, 56.

Figure 3C:
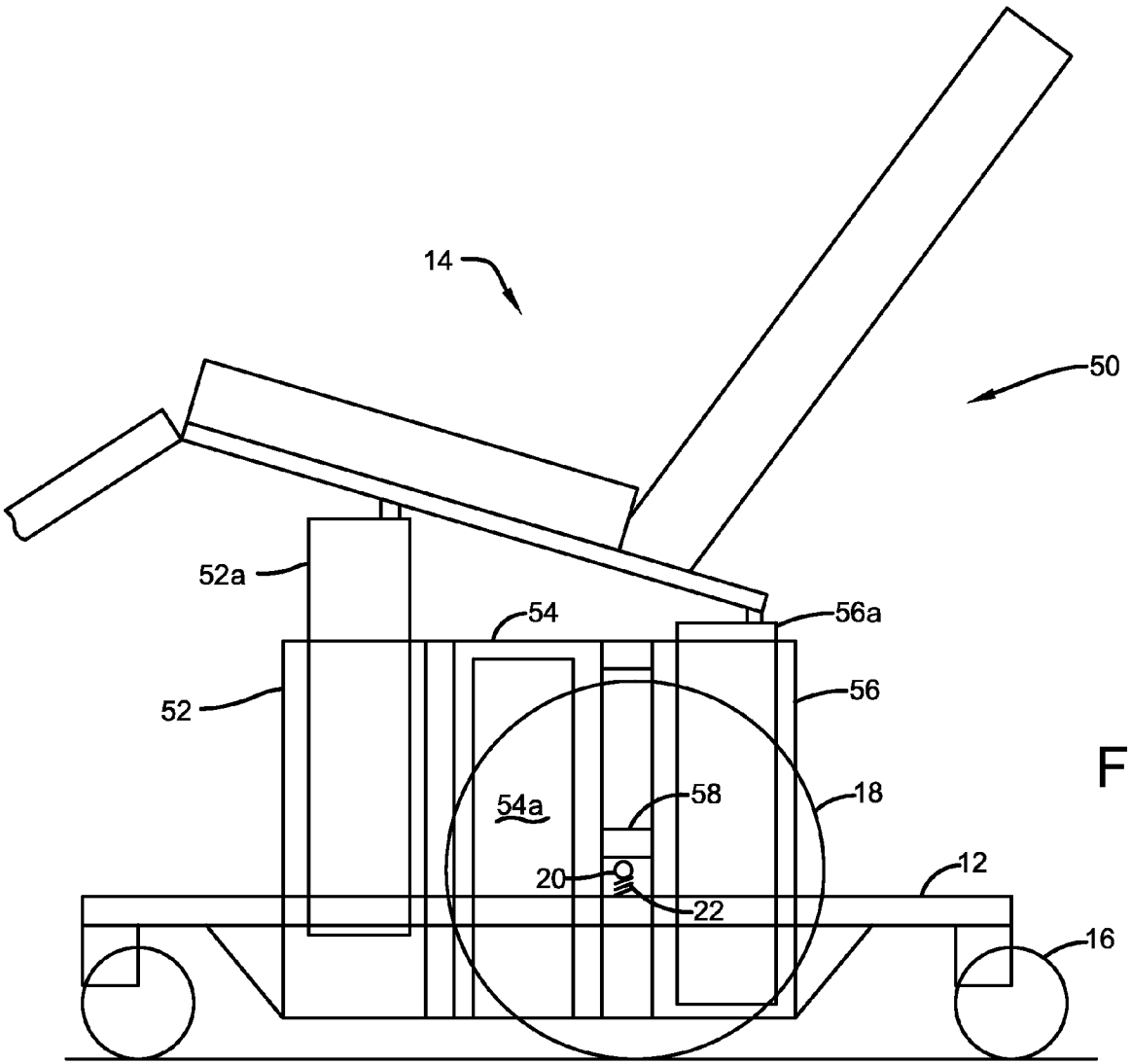

FIG. 3C shows the piston 52*a* of adjustable column 52 extended slightly, with the pistons 54*a*, 56*a* in their retracted position, allowing the stretcher chair 14 to have a slight backward tilt in the "comfort" position.

Figure 3D:
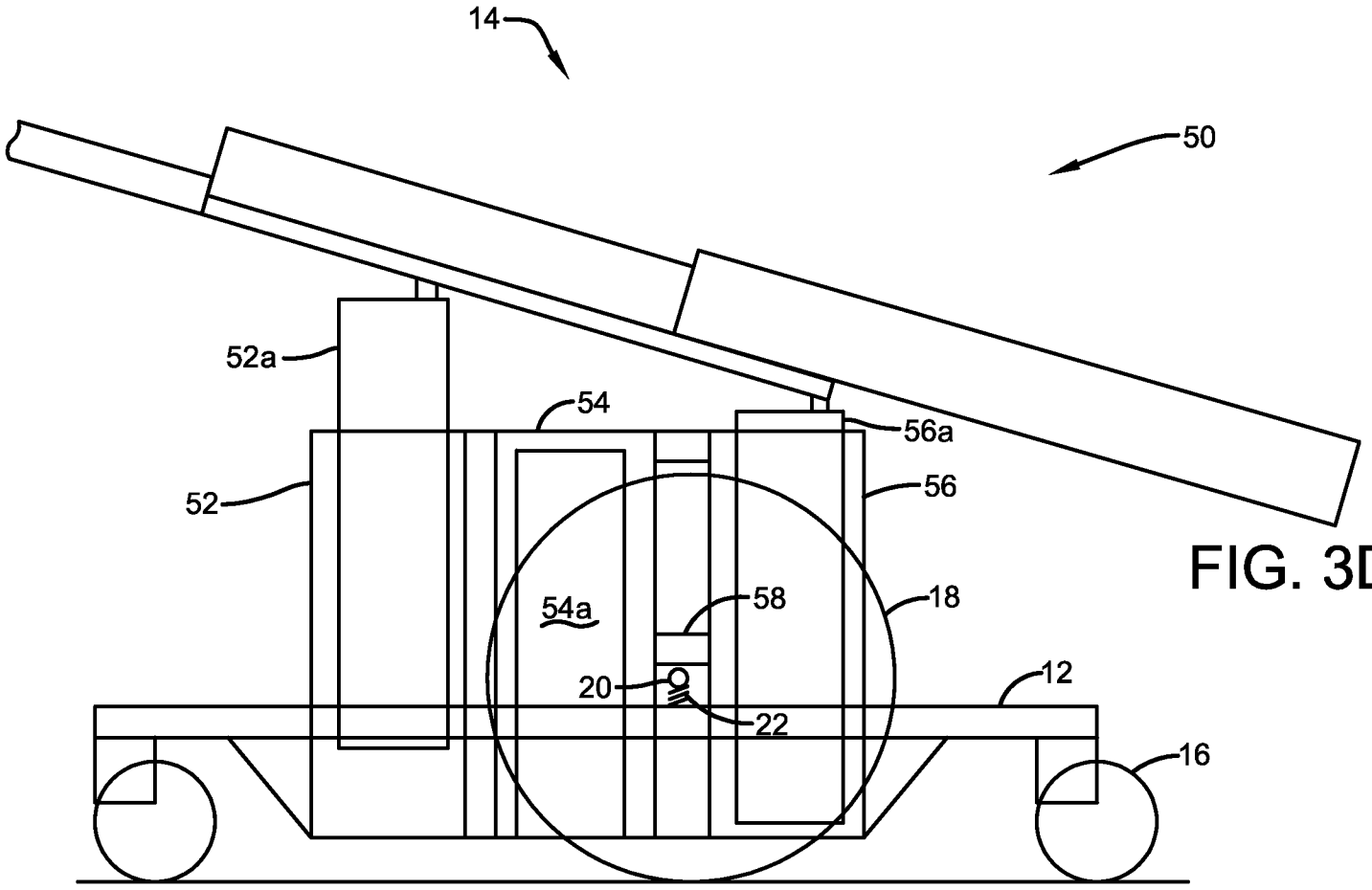

FIG. 3D shows a procedural position of the stretcher chair 14, again with the pistons 54*a*, 56*a* of the adjustable columns 54, 56 in their fully retracted position, the piston 52*a* partially extended, and with the back of the stretcher chair 14 being reclined into alignment with the seat portion thereof in a stretcher orientation.

With the adjustable column 54*a* being secured to the base 12, and the columns 52*a*, 56*a* being adjustable as just described, the outer columns 52, 56 exert the weight of the patient transport platform 50 directly onto the axle 20 of the large wheels 18. When the large wheels 18 are in contact with the floor, the spring force of the spring 22 that supported the wheels now exerts a pre-defined force onto the base 12, maintained by the caster wheels 16, thus maintaining stability.

While the outer portion of the rearward adjustable column 56 is rigidly attached to the outer portion of the center adjustable column 54 to provide stability, the outer portion of the forward adjustable column 52 may be hinged at the lower end of the center column 54 to provide a pivot and thus provide for unequal travel of the two outer adjustable columns 52, 56. This allows for significant seat tilt for the Trendelenburg (FIG. 3D) and reverse Trendelenburg positioning. The outer and upper portions of the forward column 52*a* and reverse column 56*a* are attached to the seat bottom to provide for desired vertical positioning even while the large wheel 18 remains in contact with the floor.

When the center column is raised, the large wheels 18 lift off of the axle 20, by separating the stop 58 from the axle, the large wheels 18 lift above the floor in the range of 1"-1.5" of the free floating travel of the actuator 54.

It is further presented that the friction of the glides within the columns provides a damping action that reduces teetering of the patient transport platform 50 when the center of gravity is over the large wheels 18. It is contemplated that additional dampening can be added if necessary and the same may be elastomeric, hydraulic, pneumatic, electric or rheomagnetic.

For purposes of transporting a patient, whether sitting upright as in a chair or lying horizontal as on a stretcher, the structure and operational features of the platform base are of significance. Accordingly, with reference to FIGS. 4 and 5, an appreciation can be obtained with regard to a patient transport platform base made in accordance with the invention and designated generally by the numeral 60. The platform base 60 includes a base frame 62 having caster wheel assemblies 64 disposed at each of four corners thereof A pair of caster wheels 66*a* is disposed at a fore end of the platform base 60, while a pair of caster wheels 66*b* is disposed at the aft end of the base. Positioned intermediate the fore and aft pairs of caster wheels 66*a* and 66*b* are a pair of large wheels 68. In general, the large wheels 68 preferably have a radius that exceeds the diameter of the caster wheels 66.

Figure 4:
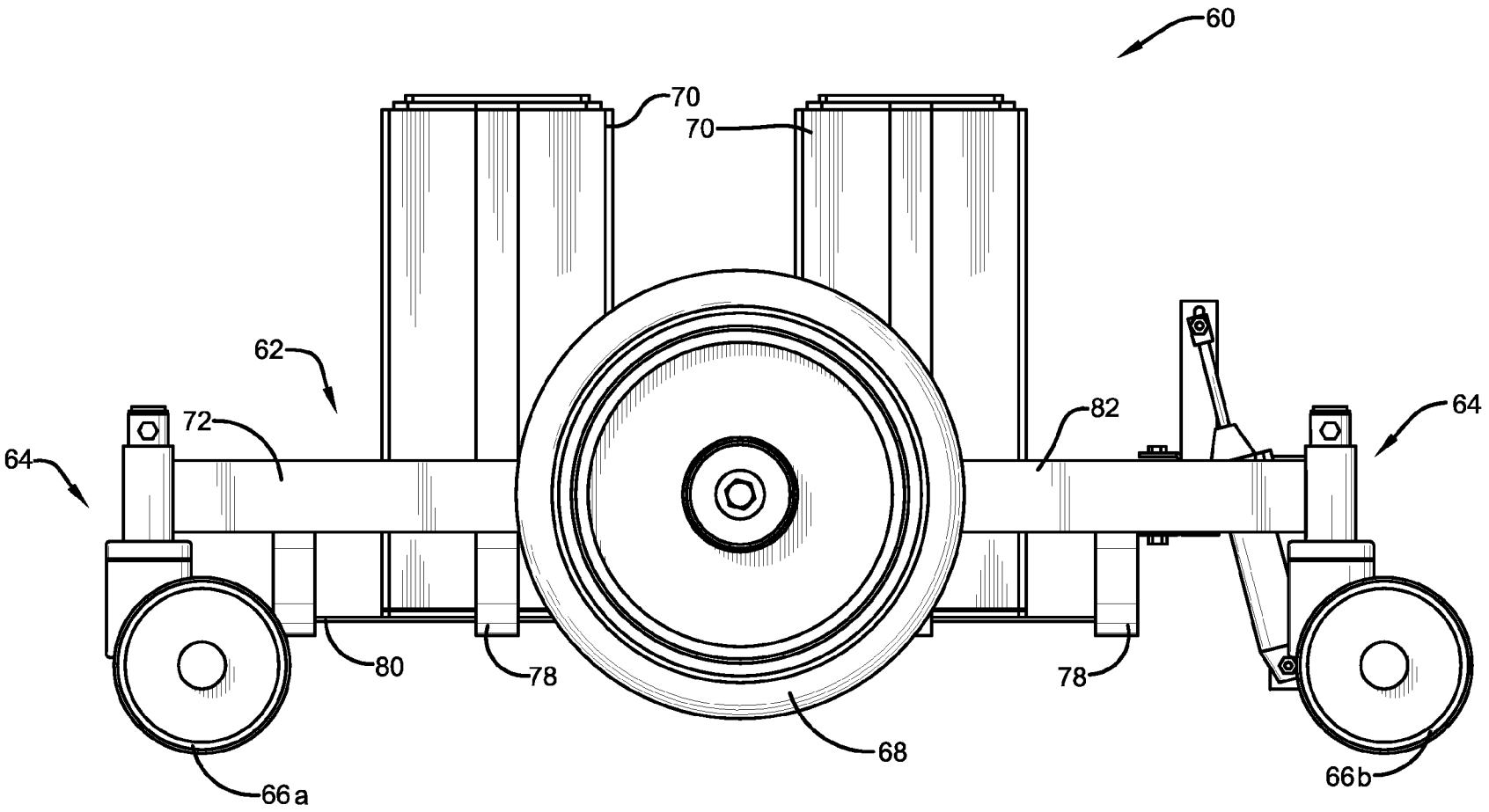
FIG. 4 is a side elevational view of a patient transport platform base according to an embodiment of the invention.

Extending upwardly from and comprising a portion of the patient transport platform base 60 are one or more column actuators 70, a pair being shown in FIG. 4, with a single column actuator being presented with regard to subsequent embodiments.

Figure 5:
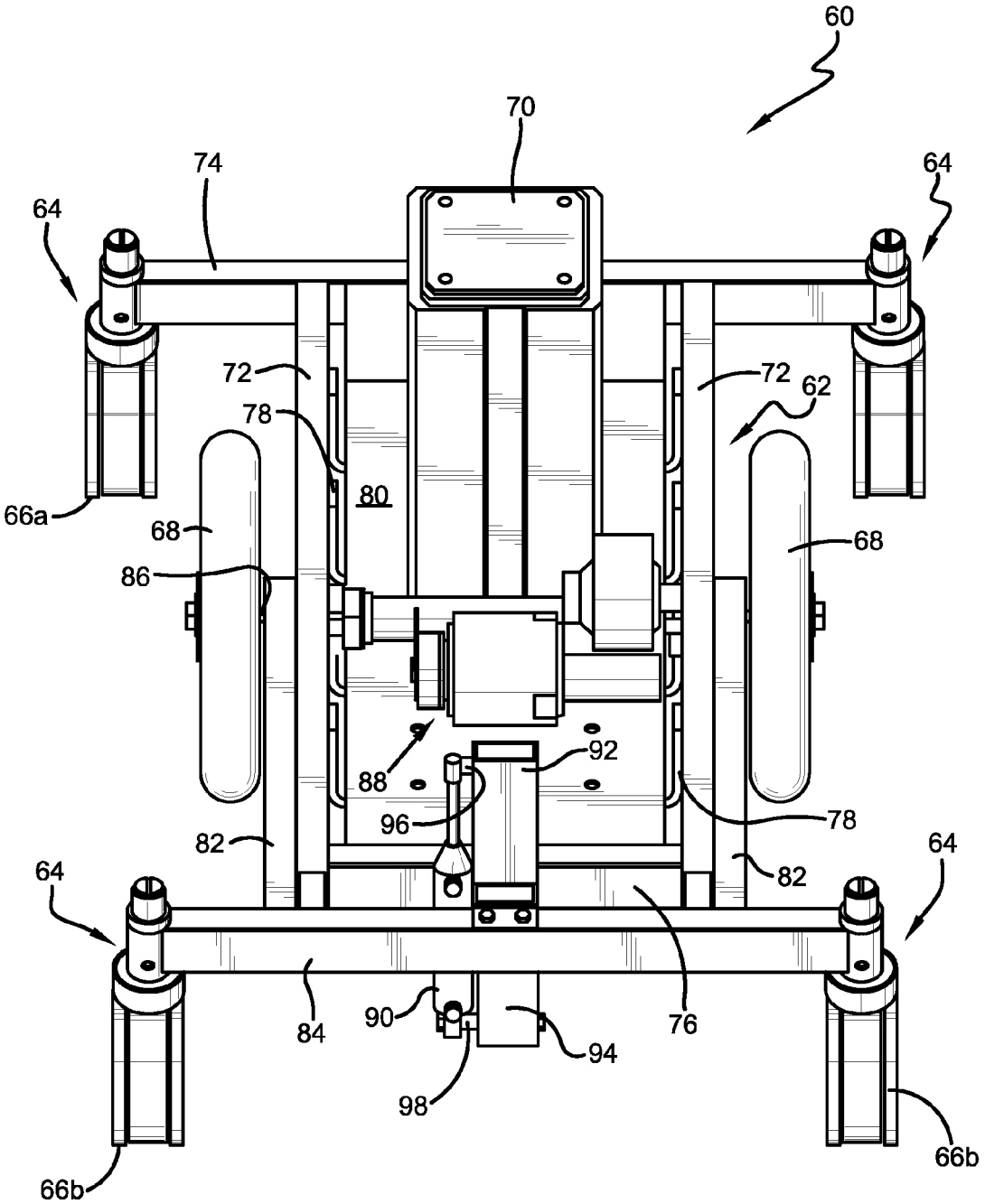
FIG. 5 is an elevated perspective view of the patient transport platform base of FIG. 4, showing a single column actuator.

The base frame 62 is divided into fore and aft portions, such portions being in articulating relationship with each other. As best shown in FIG. 5, the fore portion of the platform base 60 comprises a pair of parallel side channels 72 affixedly connected to a cross channel 74 at the fore end of the base 60, the cross channel 74 having caster wheel assemblies 64 and caster wheels 66*a* maintained on opposite ends thereof Extending downwardly from the side channels 72 and extending therebetween are spaced apart support members 78, adapted to receive and maintain a base plate 80 thereon. As shown, the base plate 80 receives the column actuators 70 and provides the main support for the structure of a chair assembly to be received thereby. The plate 80 may further receive other mechanisms, either not shown or to be discussed later herein.

The aft portion of the base frame 62 comprises a pair of parallel side channel members 82, running parallel to the pair of side channels 72. Extending across and connected to the ends of the side channels 82 is a cross channel 84, running parallel to the cross channel 74, and maintaining caster wheel assemblies 64 and associated aft caster wheels 66*b* at opposite ends thereof.

An axle 86 receives the pair of large wheels 68, as shown. Preferably, the axle 86 is appropriately mounted to and maintained by the side channels 72 and/or base plate 80. Further, according to a preferred embodiment of the invention, the pair of side channels 82 is pivotally mounted on the axle 86. According to one embodiment of the invention, the large wheels 68 are simply freewheeling, with the resultant patient transport mechanism being only manually maneuverable. According to another embodiment of the invention, the wheels 68 may be powered, as by means of a motor-driven transaxle drive mechanism 88, supported by the base plate 80 and in operative engagement with the wheels 68.

It should now be apparent that the aft portion 82, 84 of the base frame 62 is pivotally secured to the fore portion 72, 74, 76 of the base frame 62. This pivotal engagement is preferably about the axle 86, but the desired articulation might be obtained by connecting the side channel 82 to the side channel 72 by pins or the like defining appropriate pivot points.

Figure 6:
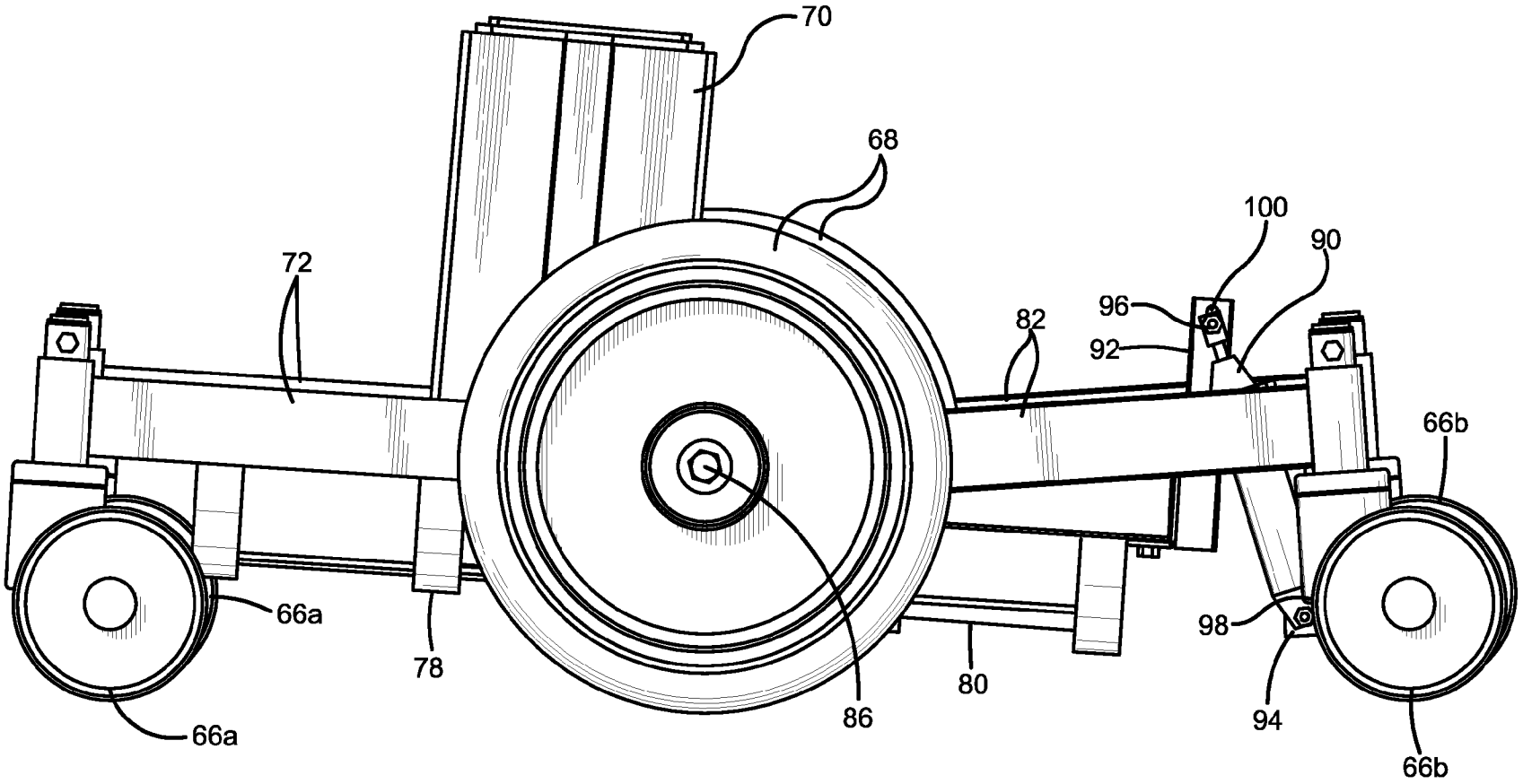
FIG. 6 is a side perspective view of the patient transport platform base of FIG. 5.

With reference now to FIGS. 5 and 6, it can be appreciated that a damper or actuator/damper mechanism is interposed between the fore and aft portions of the articulating base frame 62. The damper or actuator/damper may be either hydraulic or pneumatic. When articulation of the base frame is desired, and in embodiments where such articulation is achieved manually, the element 90 need merely be a damper. Alternatively, if deployment of the articulating base is to be achieved pneumatically or hydraulically, the element 90 may serve as a combination actuator/damper mechanism.

As shown, the mechanism 90 is interposed between a bracket 92 secured to the cross channel 76 of the fore portion of the bifurcated base frame 62 and the cross channel 84 of the aft portion of the bifurcated base frame 62. Pin connections 96, 98 respectively secure opposite ends of the mechanism 70 to the brackets 92, 94.

As best shown in FIG. 6, the bracket 92 is characterized by a slot 100 that receives the associated pin 96. This slotting provides a free-floating effect for the aft wheels 66*b*, when the large wheels 68 are in contact with the floor. The size of the slot 100 determines the nature and extent of the free float of the aft wheels 66*b*. According to an embodiment of the invention, the free float of the wheels from the planar surface defined by those wheels, and further controlled by the length of the slot 100, is on the order of plus or minus 0.5 inch and preferably plus or minus 0.25 inch. According to yet another embodiment of the invention, the free floating occurs in a range of plus or minus 0.125 inch of vertical wheel travel. Following the free floating region of operation, the damper of the mechanism 90 dampens any further relative movement between the large wheels 68 and the aft wheels 66*b*.

It is further desired, for purposes of ease of handling and patient comfort, that the axle 86 of the large wheels 68 be positioned at or behind (toward the aft end) the center of the base frame 62. In other words, with the articulating base locked such that the channels 72, 82 are aligned, and with the caster wheels 66*a* and 66*b* on the floor, and the large wheels 68 thereabove, the axle of the large wheels 68 is either at the center of the wheel base, or toward the aft portion thereof.

Figure 7:
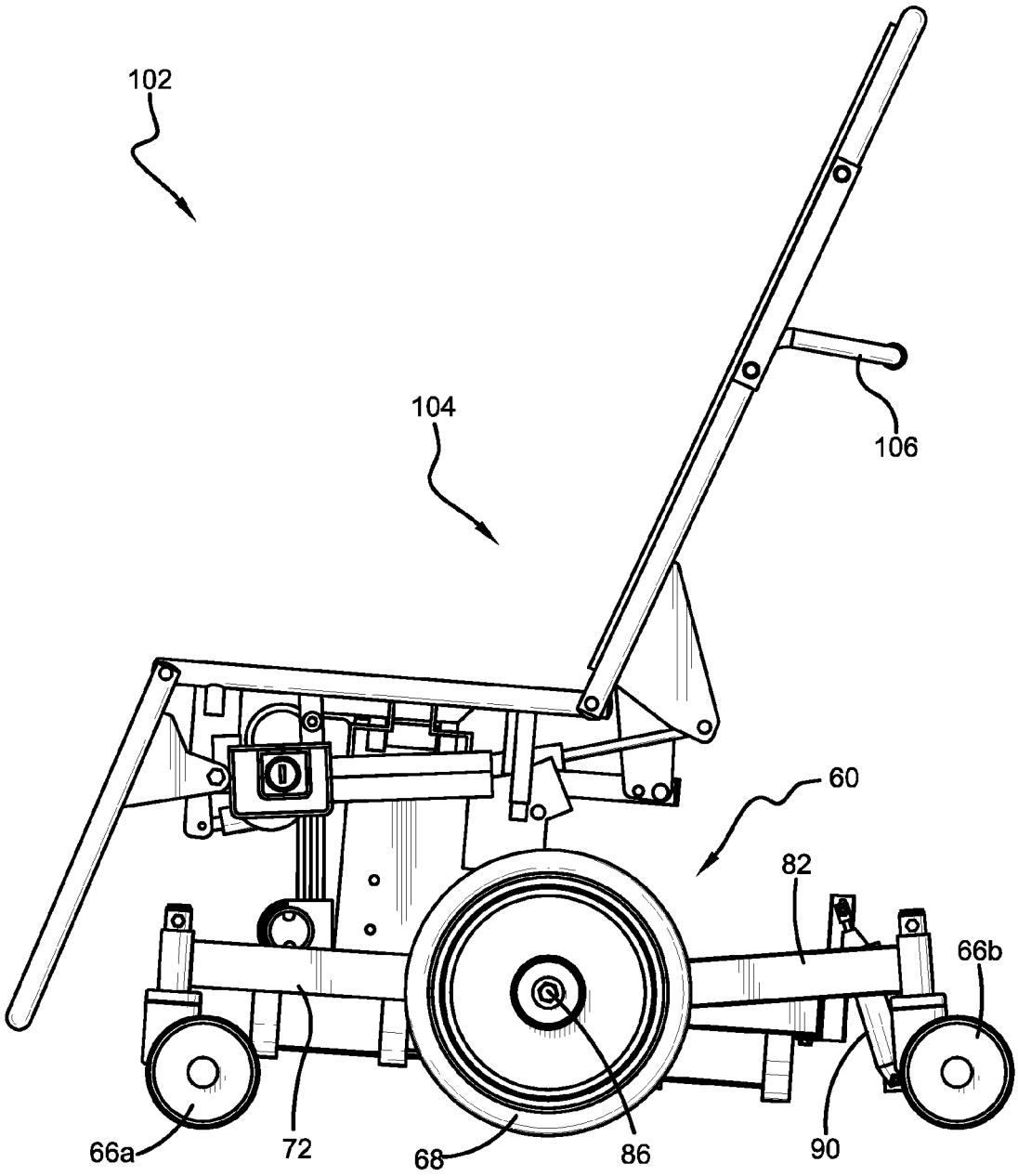
FIG. 7 is a side perspective view showing a stretcher chair in chair mode received by the patient transport platform base of FIG. 5.

With reference now to FIG. 7, the numeral 102 shows a stretcher chair 104 mounted upon a patient transport platform base 60, made in accordance with the invention. Here, the stretcher chair 104 is shown in the chair orientation. Further, the base frame 62 is shown articulated, with the channels 72, 82 angled with respect to each other. It will be appreciated that when a patient is seated within the stretcher chair 104, the center of gravity of the unit is forward of the axle 106 and floor contact is made between the large wheels 68 and the fore caster wheels 66*a*. This contact engagement is further encouraged by any motive force that is applied to the push handles 106, seeking to move the assembly 102 in the fore direction.

Figure 8:
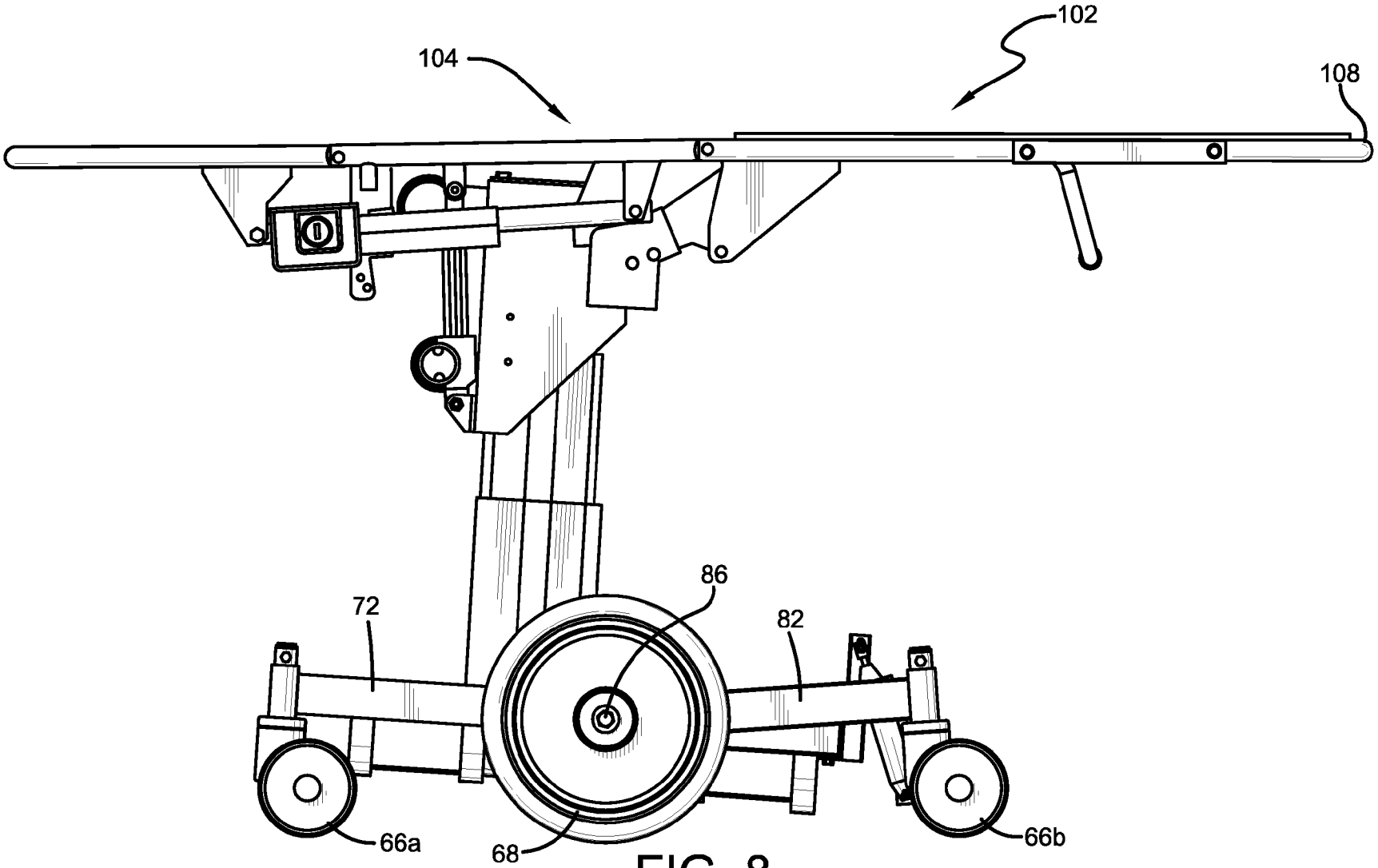
FIG. 8 is a side perspective view showing a stretcher chair in stretcher mode received by the patient transport platform base of FIG. 5.

With reference to FIG. 8, the assembly of FIG. 7 is shown with the stretcher chair 104 maneuvered to the stretcher position. Here, the center of gravity of the assembly is typically between the axle 86 of the large wheels 68 and the aft caster wheels 66*b*. Accordingly, with the aft portion of the frame being articulated with respect to the fore portion, the large wheels 68 and the aft caster wheels 66*b* are in contact with the floor, and this contact is further ensured when a motive force is applied to the end of the stretcher as at 108.

According to preferred embodiments of the invention, when the fore and aft portions of the base frame 62 are aligned with each other, as shown in FIG. 4, the large wheels 68 are lifted from the floor a distance of approximately 0.5-1.5 inch. Accordingly, on flat surfaces, the assembly may be easily maneuvered and positioned. Moreover, the assembly may accommodate deviations in the floor surface, such as thresholds, ramp transitions, and the like. For transport purposes, with the base frame 62 being articulated, the benefit of maximizing the weight on the large diameter wheels 68 can be attained, whether those wheels are driven or freewheeling, and transport can be achieved with ease and comfort for the patient. The non-contacting pair of caster wheels (66*a* or 66*b*) is only off of the plane of the contacting wheels on the order of approximately 0.75-1.5 inch, and preferably 1.0 inch. Accordingly, when a threshold, floor deviation, ramp, or the like is encountered and an intermittent shifting of contact occurs, the free floating nature of the aft caster wheels 66*b* afforded by the slot 100, followed by the damping effect of the damper or actuator/damper 90, ensures patient comfort and unit stability. Only a small free float of the aft caster wheel pair 66*b* is experienced before any necessary further travel of the caster wheel pair 66*b* is experienced in a dampened mode.

It should now be appreciated with regard to the embodiments of the invention shown in FIGS. 4-8 that a bifurcated articulating base allows for accommodation of a convertible patient transport device for transporting a patient when the device is either in the chair or stretcher mode. It is preferred that a pair of large wheels 68 is mounted to the base in a region beginning at a midpoint of the base and extending toward the pair of aft caster wheels 66*b*. When the articulating base is maneuvered to a first positional relationship, the large wheels are positioned above a plane established by the lowermost surfaces of the pairs of caster wheels, while in a second positional relationship, the pair of large wheels extends partially below the planes when the stretcher chair 104 maintains a patient in the chair mode, the center of gravity of the patient transport device 102 has a center of gravity between the axle of the large wheels 68 and the pair of fore caster wheels 66*a*. In similar manner, when a patient is maintained in the stretcher mode, that center of gravity lies between the axle 86 of the large wheels 68 and the pair of aft caster wheels 66*b*. This defines whether the fore or aft caster wheels will be in floor contact in combination with the pair of large wheels 68.

The embodiments of the invention of FIGS. 4-8 further allow the fore and aft portions of the base to articulate with respect to each other when the pair of large wheels 68 is partially below the plane established by the lower outermost surfaces of the pair of caster wheels 66*a* and 66*b*. A damper and/or actuator/damper mechanism 100 operatively interconnects the fore and aft portions of the base and has a free float range defined by a slotted connection as at 100, allowing for undamped movement between the fore and aft section of a limited nature, on the order of 0.125-0.375 inch. Alternatively or additionally, the damper or actuator/damper may have a characteristic dead band or a progressive damping characteristic. Of course, the extent of such free floating is controlled by the length and/or configuration of the slotted connection 100. This free float range is followed by a dampened range of operation, minimizing teetering when the patient transport device is in motion.

The fore and aft portions of the base articulate about the axle 86 of the pair of large wheels 68, which wheels may be either freewheeling or driven, as by a transaxle 88 or the like. In other words, the concepts of the invention are adaptable to powered or manually driven patient transport devices.

Thus it can be seen that the various aspects of the invention have been achieved by the different embodiments presented and described herein. While in accordance with the patent statutes only the best mode and preferred embodiments of the invention have been presented and described in detail, the invention is not limited thereto or thereby. Accordingly, for an appreciation of the true scope and breadth of the invention reference should be made to the following claims.

What is claimed is:

1. A patient transport device, comprising:

a bifurcated articulating base having fore and aft portions;

a pair of fore caster wheels connected to said fore portion and a pair of aft caster wheels connected to said aft portion;

at least one large wheel, larger in diameter than said fore and aft caster wheels, interposed between said pairs of fore and aft caster wheels;

an actuator interposed between said fore and aft portions and effecting articulation therebetween and thereby altering vertical positional relationships among said at least one large wheel and said pairs of fore and aft caster wheels; and wherein said fore and aft portions of said base are free to articulate with respect to each other when said at least one large wheel is partially below a plane established by lowermost surfaces of said pairs of caster wheels, and a damper is interposed between said fore and aft portions of said base, said damper being characterized by a free float range in which movement between said fore and aft portions of said base is undamped.

2. The patient transport device according to claim 1, wherein said at least one large wheel is mounted to said base in a region beginning at a midpoint of said base and extending toward said pair of aft caster wheels.

3. The patient transport device according to claim 1, wherein in a first position said at least one large wheel is above said plane established by lowermost surfaces of said pairs of caster wheels.

4. The patient transport device according to claim 3, wherein in a second position said at least one large wheel is partially below said plane established by lowermost surfaces of said pairs of caster wheels.

5. The patient transport device according to claim 4, wherein said fore and aft portions of said base articulate about an axle of said at least one large wheel.

6. The patient transport device according to claim 5, wherein said at least one large wheel comprises a pair of large wheels rotatably received upon said axle.

7. The patient transport device according to claim 6, wherein said pair of large wheels are freewheeling upon said axle.

8. The patient transport device according to claim 6, wherein each wheel of said pair of large wheels has a diameter at least 1.5 times a diameter of said caster wheels.

9. The patient transport device according to claim 6, further comprising a motor-powered transaxle receiving and driving said pair of large wheels.

10. The patient transport device according to claim 1, wherein said free float range is accommodated by said damper being connected to said aft portion of said base through a slotted connection.

11. The patient transport device according to claim 10, wherein an extent of said free float range is a function of a configuration of said slotted connection.

12. The patient transport device according to claim 1, wherein said damper minimizes teetering when the patient transport device is in motion.

13. A patient transport device, comprising:

a base;

castered wheels attached to said base;

a support structure mounted to said base for receiving and maintaining a patient;

first and second height adjusting mechanisms mounted in series between said base and said support structure;

an axle with at least one large wheel supported by springs from the base;

said first height adjusting mechanism having an ability to engage the axle of the at least one large wheel for a short distance at the lower end of its stroke; and where said first height adjusting mechanism has the ability to vertically float toward the bottom of the stroke when said at least one large wheel is both in contact with the floor surface and supporting more than half of the weight of the patient support device.

14. The patient transport device according to claim 13, wherein a double wishbone suspension is interposed between said first and second height adjusting mechanisms.

15. The patient transport device according to claim 13, further comprising a third height adjusting mechanism in parallel interconnection with said second height adjusting mechanism.

* * * * *